US005524389A

United States Patent [19]

Dennison

[11] Patent Number: 5,524,389

[45] Date of Patent: Jun. 11, 1996

[54] MAGNETIC WINDOW SUPPORTING SYSTEM

[76] Inventor: Raymond L. Dennison, 227 E. Linden St., Kennett Square, Pa. 19348

[21] Appl. No.: 415,245

[22] Filed: Apr. 5, 1995

[51] Int. Cl.[6] ..... E05F 3/00

[52] U.S. Cl. ..... 49/451; 292/251.5

[58] Field of Search ..... 49/450, 449, 451; 292/251.5

[56] References Cited

U.S. PATENT DOCUMENTS 1,289,305 12/1918 Thomas ..... 49/451 X 2,524,924 10/1950 Pampallona ..... 292/251.5

2,607,961 8/1952 Allen ..... 49/451 X

*Primary Examiner*—Philip C. Kannan

[57] ABSTRACT

A system for supporting a sliding window panel relative to a window frame. The inventive device includes a window frame mountable within an opening of a building structure. A window panel is slidably mounted within the window frame for permitting opening of the window. A pair of magnetic securing assemblies are secured to opposed sides of the window frame and window panel to support the window panel in an open position.

3 Claims, 3 Drawing Sheets

MAGNETIC WINDOW SUPPORTING SYSTEM

BACKGROUND OF THE INVENTION

1. Field of the Invention

The present invention relates to window structures and more particularly pertains to an magnetic window supporting system for supporting a sliding window panel relative to a window frame.

2. Description of the Prior Art

The use of window structures is known in the prior art. More specifically, window structures heretofore devised and utilized are known to consist basically of familiar, expected and obvious structural configurations, notwithstanding the myriad of designs encompassed by the crowded prior art which have been developed for the fulfillment of countless objectives and requirements.

While the prior art window structures fulfill their respective, particular objectives and requirements, the prior art does not disclose a magnetic window supporting system for supporting a sliding window panel relative to a window frame which includes a window frame mountable within an opening of a building structure, a window panel slidably mounted within the window frame for permitting opening of the window, and a pair of magnetic securing assemblies secured to opposed sides of the window frame and window panel to support the window panel in an open position.

In these respects, the magnetic window supporting system according to the present invention substantially departs from the conventional concepts and designs of the prior art, and in so doing provides an apparatus primarily developed for the purpose of supporting a sliding window panel relative to a window frame.

SUMMARY OF THE INVENTION

In view of the foregoing disadvantages inherent in the known types of window structures now present in the prior art, the present invention provides a new magnetic window supporting system construction wherein the same can be utilized for supporting a sliding window panel relative to a window frame. As such, the general purpose of the present invention, which will be described subsequently in greater detail, is to provide a new magnetic window supporting system apparatus and method which has many of the advantages of the window structures mentioned heretofore and many novel features that result in a magnetic window supporting system which is not anticipated, rendered obvious, suggested, or even implied by any of the prior art window structures, either alone or in any combination thereof.

To attain this, the present invention generally comprises a system for supporting a sliding window panel relative to a window frame. The inventive device includes a window frame mountable within an opening of a building structure. A window panel is slidably mounted within the window frame for permitting opening of the window. A pair of magnetic securing assemblies are secured to opposed sides of the window frame and window panel to support the window panel in an open position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new magnetic window supporting system apparatus and method which has many of the advantages of the window structures mentioned heretofore and many novel features that result in a magnetic window supporting system which is not anticipated, rendered obvious, suggested, or even implied by any of the prior art window structures, either alone or in any combination thereof.

It is another object of the present invention to provide a new magnetic window supporting system which may be easily and efficiently manufactured and marketed.

It is a further object of the present invention to provide a new magnetic window supporting system which is of a durable and reliable construction.

An even further object of the present invention is to provide a new magnetic window supporting system which is susceptible of a low cost of manufacture with regard to both materials and labor, and which accordingly is then susceptible of low prices of sale to the consuming public, thereby making such magnetic window supporting systems economically available to the buying public.

Still yet another object of the present invention is to provide a new magnetic window supporting system which provides in the apparatuses and methods of the prior art some of the advantages thereof, while simultaneously overcoming some of the disadvantages normally associated therewith.

Still another object of the present invention is to provide a new magnetic window supporting system for supporting a sliding window panel relative to a window frame.

Yet another object of the present invention is to provide a new magnetic window supporting system which includes a window frame mountable within an opening of a building structure, a window panel slidably mounted within the window frame for permitting opening of the window, and a pair of magnetic securing assemblies secured to opposed sides of the window frame and window panel to support the window panel in an open position.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
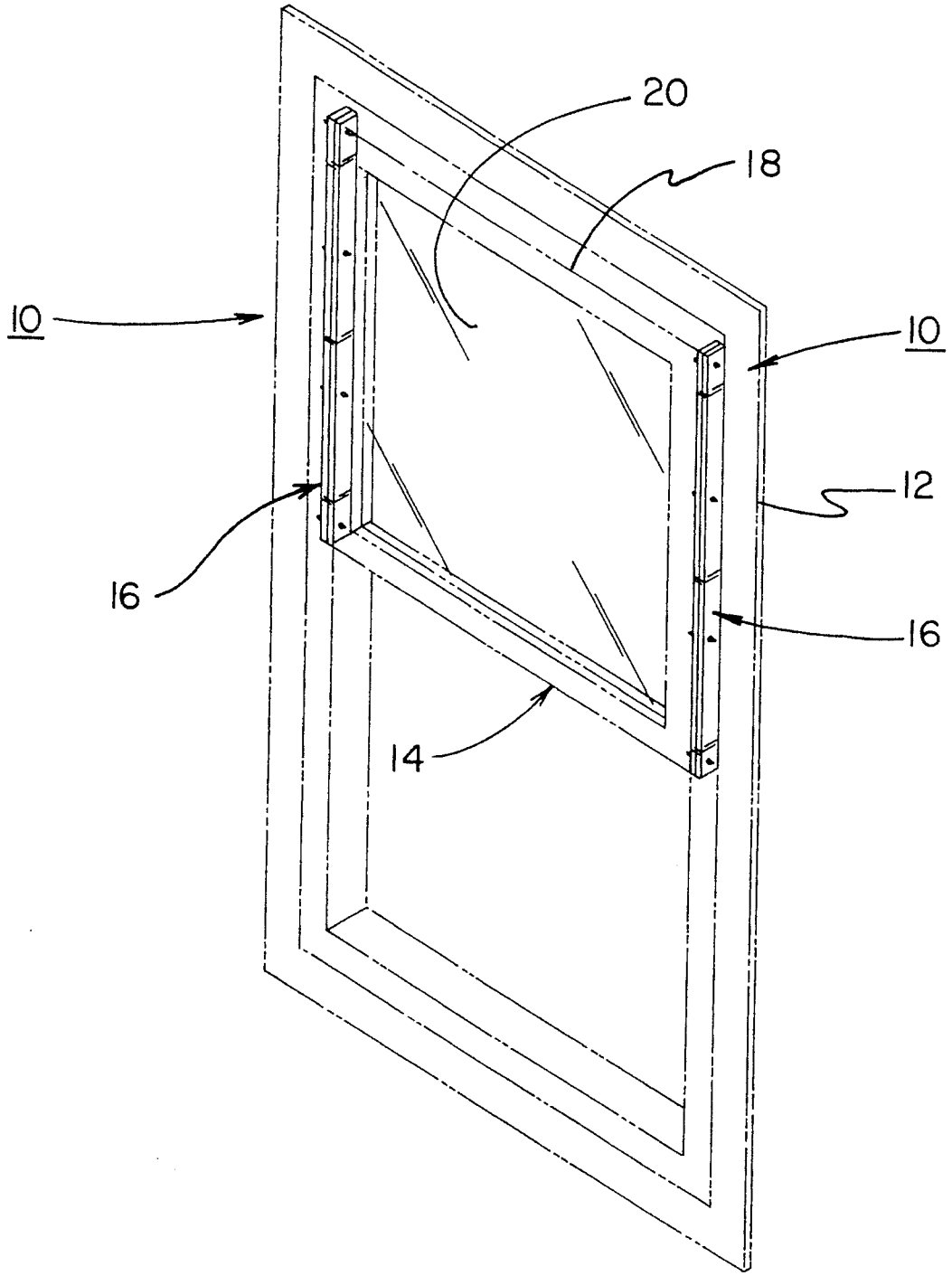
FIG. 1 is an isometric illustration of a magnetic window supporting system according to the present invention.

With reference now to the drawings, and in particular to FIGS. 1–6 thereof, a new magnetic window supporting system embodying the principles and concepts of the present invention and generally designated by the reference numeral 10 will be described.

More specifically, it will be noted that the magnetic window supporting system 10 comprises a window frame 12 for mounting within an aperture of an unillustrated building structure wall. A sliding window panel 14 is movably mounted within the window frame 12 for vertical reciprocation relative thereto so as to permit opening of the window as illustrated in FIG. 1 of the drawings. A magnetic securing means 16 is secured to opposed exterior surfaces of the sliding window panel 14 as well as to opposed interior surfaces of the window frame 12 for securing the sliding window panel 14 relative to the window frame 12. By this structure, the window panel 14 can be opened and secured in a desired position relative to the window frame 12.

Figure 2:
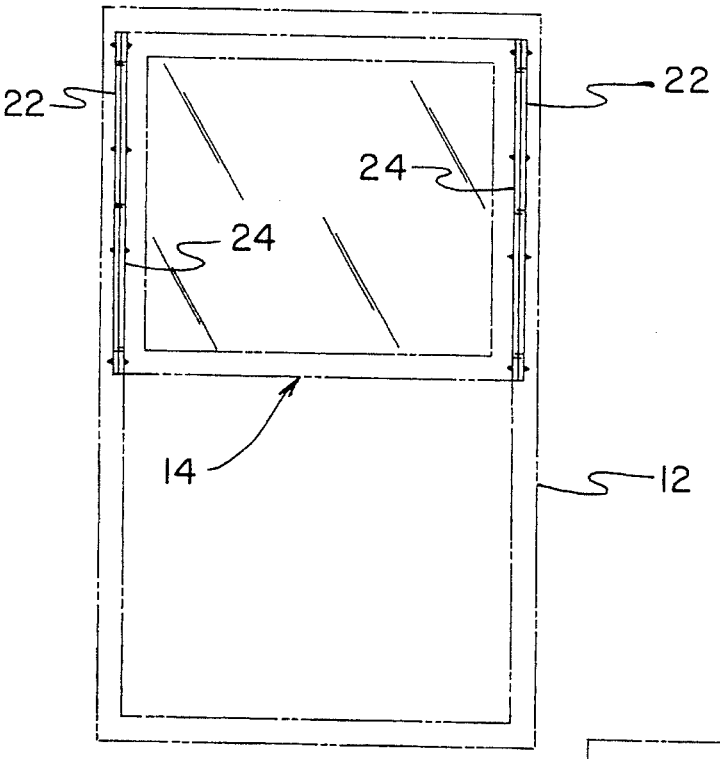
FIG. 2 is a front elevation view of the invention in an opened configuration.
Figure 3:
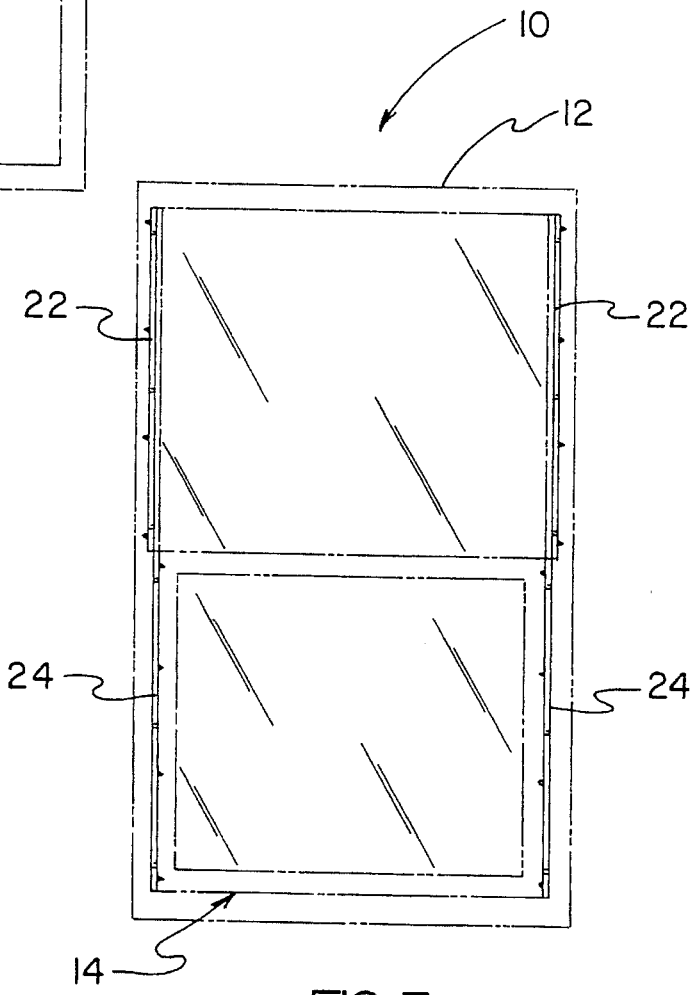
FIG. 3 is a front elevation view of the invention in a closed configuration.

As best illustrated in FIGS. 1 through 3, it can be shown that sliding window panel 14 according to the present invention 10 preferably comprises a perimeter frame 18 movably mounted within the window frame 12 by conventional guiding structures such as cooperatively engagable grooves and projections. A glass pane 20 extends across the perimeter frame 18 so as to permit viewing of objects exterior of the building structure through the sliding window panel 14. By this structure, the sliding window panel 14 can be selectively reciprocated within the confines of the window frame 12 to permit opening of the window as shown in FIGS. 1 and 2 of the drawings. As shown in FIG. 3, the sliding window panel 14 can be lowered into a lower most position so as to close the window.

With continuing reference to FIGS. 1 through 3, it can be shown that the magnetic securing means 16 according to the present invention 10 preferably comprises a pair of window frame plates 22 secured to opposed interior surfaces of the window frame 12 proximal to an upper end thereof. Preferably, the window frame plates 22 are of a first longitudinal length, with the window frame 12 having a second longitudinal length, wherein the second longitudinal length is substantially greater than the first longitudinal length. Preferably, the second longitudinal length equals approximately two times the first longitudinal length such that the window frame plates 22 extend along approximately one-half of the longitudinal length of the window frame 12 so as to cover the upper half thereof. The magnetic securing means 16 of the present invention 10 further comprises a pair of window panel plates 24 mounted to opposed exterior lateral surfaces of the sliding window panel 14 and configured for adjacent positioning relative to the window frame plates 22 when the sliding window panel 14 is in the opened configuration as illustrated in FIGS. 1 and 2 of the drawings. To support the sliding window panel 14 in the open configuration shown in FIGS. 1 and 2, either or both of the frame plates 22 or 24 is comprised of a substantially magnetic material. More specifically, the window frame plates 22 may be comprised of a substantially magnetic material, with the window panel plates 24 being comprised of a substantially ferrous material wherein the attraction between the plates 22 and 24 retains the sliding window panel 14 is the opened configuration. Alternatively, the window panel plates 24 can be comprised of a magnetic material, with the window frame plates 22 being comprised of a substantially ferrous material, whereby the magnetic attraction between the plates 22 and 24 retains the sliding window panel 14 in the opened configuration in a similar manner. Preferably, the window frame plates 22 are comprised of a substantially magnetic material, with the window panel plates 24 also being comprised of a substantially magnetic material so as to provide for increased magnetic attraction between the plates 22 and 24 relative to an amount of magnetic material used in their construction. To this end, the window frame plates 22 are preferably constructed such that they include north and south poles, with the north pole of the plates being secured towards an upper end of the window frame 12. Similarly, the window panel plates 24 are preferably comprised of a magnetic material including north and south poles, with north poles thereof being secured towards lower portions of the sliding window panel 14. By this structure, the south poles of the frame plates and panel plates 22 and 24 will be positioned proximal to one another so as to create a magnetic repulsion retaining the sliding window panel 14 in the closed configuration illustrated in FIG. 3. Further, when the window panel 14 is in the open position illustrated in FIGS. 1 and 2, the south pole of the window panel plates 24 will be positioned proximal to the north pole of the window frame plates 22, with the north pole of window panel plates 24 being positioned proximal to the south pole of the window frame plates 22 to create a magnetic attraction between the panel plates 24 and the frame plates 22 retaining the sliding window panel 14 in the open configuration.

Figure 4:
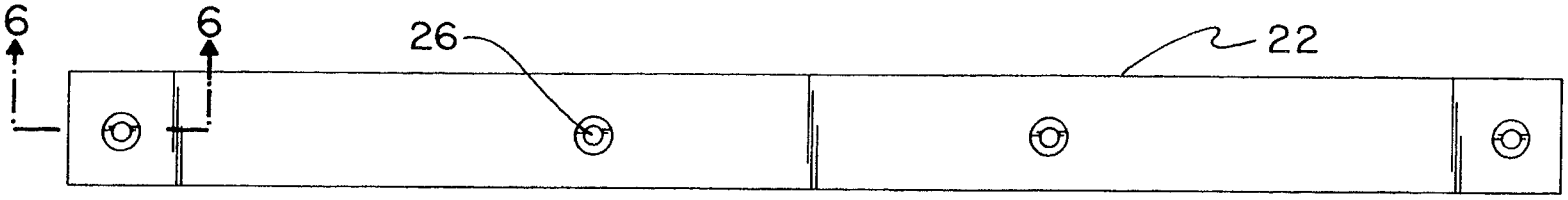
FIG. 4 is a plan view of a window frame plate comprising a portion of the present invention.
Figure 5:
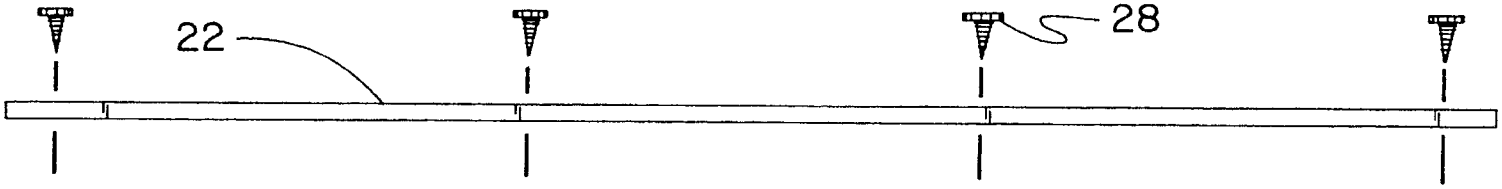
FIG. 5 is a side elevation view of the window frame plate.
Figure 6:
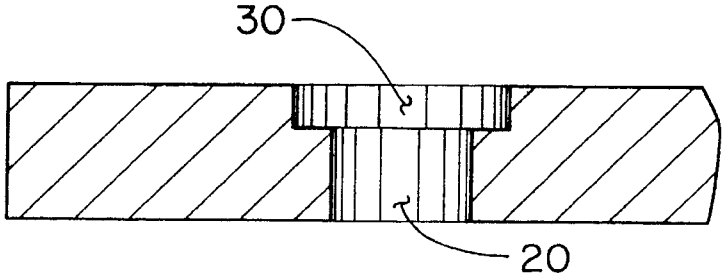
FIG. 6 is a cross sectional view taken along line 6—6 of FIG. 4.

Referring now to FIGS. 4 through 6 wherein a single one of the window frame plates 22 is illustrated in detail, it can be shown that the plates 22 and 24 are substantially similar in design and configuration and each comprise an elongated member having a plurality of mounting apertures 26 directed therethrough permitting passage of a plurality of fasteners 28 for coupling of the magnetic securing means 16 to the window frame 12 and sliding window panel 14 in the configuration described above. As shown in FIG. 6, the mounting apertures 26 may each include a counter-sunk bore 30 permitting flush positioning of the fasteners 28 relative to the plates 22 or 24.

In use, the magnetic window supporting system 10 according to the present invention can be easily utilized to support a sliding window panel 14 in an open positioned within a window frame 12. The present invention may be sold as a kit wherein only the magnetic securing means 16 is provided such that an individual may retrofit an existing window frame 12 and sliding window panel 14 so as to arrive at the present invention.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A magnetic window supporting system for use with a window frame having a sliding window panel movably mounted within the window frame for reciprocation relative thereto comprising;

a set of flat plates on each side of said window frame, said plates each having a flat face on one plate parallel to a corresponding flat face on the other of said plates, one of said plates being affixed to the window frame and the other of said plates being affixed to the sliding window panel, said plates being in proximal relationship to one another on each side of said frame, with the plates secured to the window frame being approximately twice the length of the plates secured to the sliding window panel;

a magnetic surface coextensive with and forming the surface of at least one plate of each set of plates and a ferrous material surface coextensive with and forming the surface of at least the other plate of each set of plates.

2. A system as in claim 1 wherein said plates secured to the window frame have a magnetic surface and said plates secured to the sliding window panel have a ferrous material surface.

3. A system as in claim 1 wherein said plates secured to the window frame have a ferrous material surface and said plates secured to the sliding window panel have a magnetic surface.

* * * * *